US006033238A

United States Patent [19]

Fogg et al.

[11] Patent Number: 6,033,238

[45] Date of Patent: Mar. 7, 2000

[54] RIBBON CABLE CONNECTOR WITH GROUND BUS

[75] Inventors: Michael Warren Fogg; Mai-Loan Thi Tran, both of Harrisburg; Benjamin Howard Mosser, III, Middletown; Robert Correll, Jr., Harrisburg, all of Pa.

[73] Assignee: The Whitaker Corporation, Wilmington, Del.

[21] Appl. No.: 08/866,505

[22] Filed: May 30, 1997

[51] Int. Cl.[7] ..... H01R 4/66

[52] U.S. Cl. ..... 439/108; 439/492; 439/499

[58] Field of Search ..... 439/101, 108, 439/492, 497, 499

[56] References Cited

U.S. PATENT DOCUMENTS

| | | | |
|---|---|---|---|
| 4,027,941 | 6/1977 | Narozny | 439/402 |
| 4,068,912 | 1/1978 | Hudson, Jr. et al. | 439/405 |
| 4,073,560 | 2/1978 | Anhalt et al. | 339/99 |
| 4,094,564 | 6/1978 | Cacolici | 439/497 |
| 4,140,360 | 2/1979 | Huber | 339/176 |
| 4,227,763 | 10/1980 | Marks | 339/99 |
| 4,252,396 | 2/1981 | Wilson | 439/499 |
| 4,252,397 | 2/1981 | Eigenbrode et al. | 439/499 |
| 4,260,209 | 4/1981 | Zell et al. | 339/14 |
| 4,406,512 | 9/1983 | Schell | 339/177 |
| 4,681,382 | 7/1987 | Lockard | 439/92 |
| 4,925,401 | 5/1990 | Fogg et al. | 439/465 |
| 4,993,968 | 2/1991 | Guletsky et al. | 439/492 |
| 5,174,770 | 12/1992 | Sasaki et al. | 439/108 |
| 5,338,221 | 8/1994 | Bowen et al. | 439/405 |
| 5,547,385 | 8/1996 | Spangler | 439/108 |

FOREIGN PATENT DOCUMENTS

WO 98/39819 9/1998 WIPO .

*Primary Examiner*—Paula Bradley
*Assistant Examiner*—Katrina Davis
*Attorney, Agent, or Firm*—Robert Kapalka

[57] ABSTRACT

An electrical connector for terminating flat cable of the type having a plurality of signal and ground conductors in parallel alignment comprises a housing which holds a plurality of signal contacts and a ground bus. Each of the signal contacts has a signal conductor termination slot configured for insulation displacement termination of a respective said signal conductor. The ground bus has a plurality of ground conductor termination slots each configured for insulation displacement termination of a respective said ground conductor, and at least one bypass slot configured to permit at least one of said signal conductors to pass through said ground bus without termination thereto. The signal conductor termination slots, the ground conductor termination slots and the at least one bypass slot are arranged such that the plurality of signal and ground conductors reside in a common plane in the connector after termination thereto.

22 Claims, 6 Drawing Sheets

RIBBON CABLE CONNECTOR WITH GROUND BUS

FIELD OF THE INVENTION

The invention relates to a connector for terminating flat ribbon cable having a plurality of closely-spaced parallel signal and ground conductors.

BACKGROUND OF THE INVENTION

U.S. Pat. No. 4,260,209 discloses an electrical connector for terminating flat ribbon cable of the type having a plurality of signal and ground conductors enclosed in an insulative jacket. The connector has signal contacts with slotted beams for insulation displacement termination of the signal conductors, and a ground bus with slotted beams for insulation displacement termination of the ground conductors. The slotted beams of the signal contacts are disposed at one elevation, and the slotted beams of the ground bus are disposed at a different elevation. Prior to termination, the insulative jacket must be stripped to expose the signal and ground conductors individually so as to permit separation of the signal and ground conductors into different planes. The stripping operation is time consuming and adds to manufacturing cost. Further, after the signal and ground conductors are terminated they reside at different heights in the connector, thereby increasing the overall size of the connector.

U.S. Pat. No. 4,681,382 discloses an electrical connector for terminating flat ribbon cable wherein the signal and ground conductors reside at the same height after termination. However, a portion of the insulative jacket still must be stripped from the signal and ground conductors prior to termination. Also, the unstripped portion of the flat cable is bent back over the connector after termination so that it can be gripped by a strain relief. There is a need for a simpler and more effective connector for terminating flat ribbon cable.

SUMMARY OF THE INVENTION

The invention is an electrical connector for terminating flat cable of the type having a plurality of signal and ground conductors in parallel alignment. The connector comprises a housing which holds a plurality of signal contacts and a ground bus. Each of the signal contacts has a signal conductor termination slot configured for insulation displacement termination of a respective said signal conductor. The ground bus has a plurality of ground conductor termination slots each configured for insulation displacement termination of a respective said ground conductor, and at least one bypass slot configured to permit at least one of said signal conductors to pass through said ground bus without termination thereto. According to the invention, the signal conductor termination slots, the ground conductor termination slots and the at least one bypass slot are arranged such that the plurality of signal and ground conductors reside in a common plane in the connector after termination thereto.

According to another aspect of the invention, the ground bus also has a signal conductor termination slot configured for insulation displacement termination of a respective one of the signal conductors.

BRIEF DESCRIPTION OF THE DRAWINGS

The invention will now be described by way of example with reference to the accompanying drawings wherein.

DETAILED DESCRIPTION OF AN EMBODIMENT OF THE INVENTION

Figure 1:
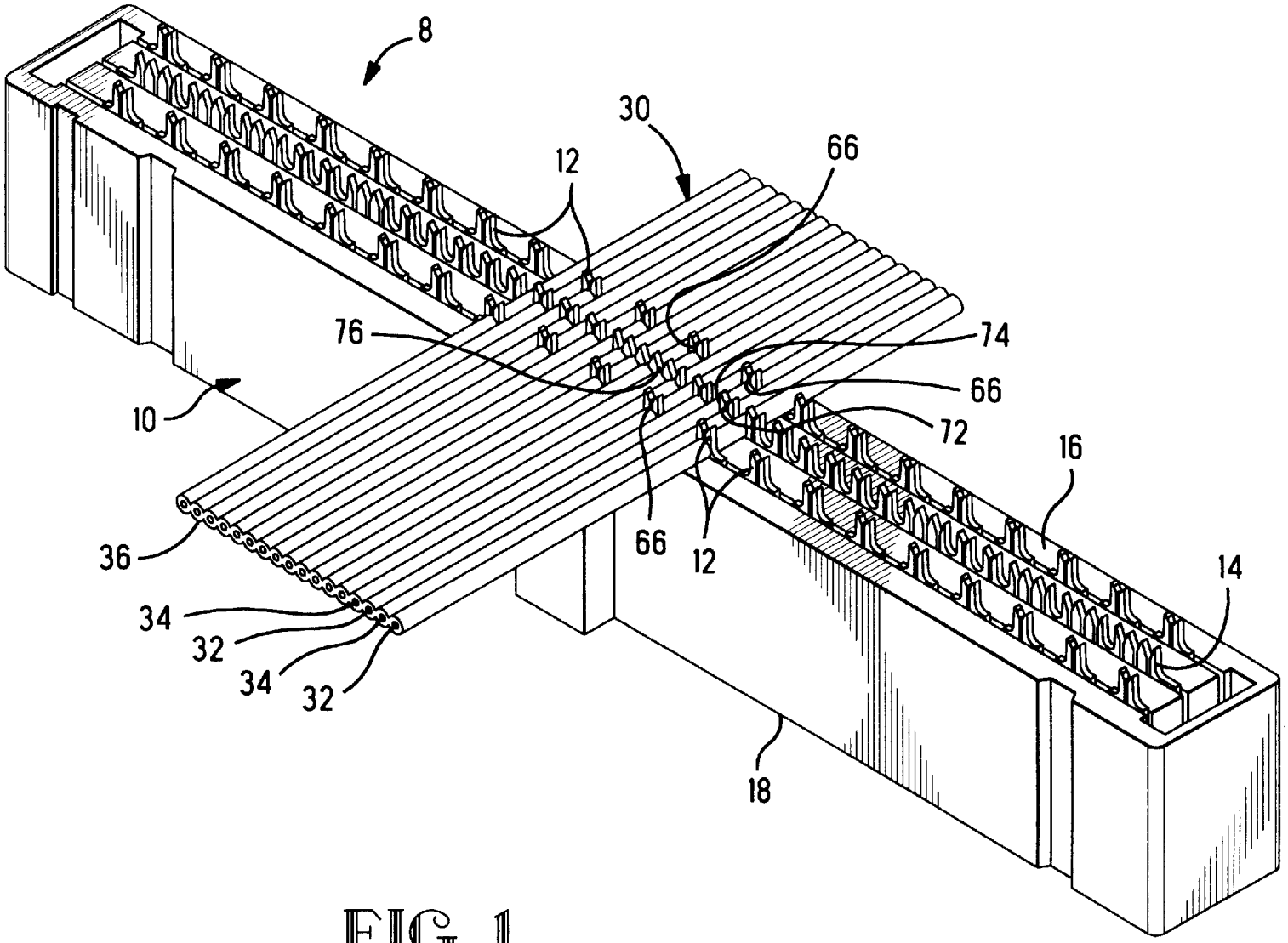
FIG. 1 is an isometric view of an electrical connector according to the invention terminated to a ribbon cable.

There is shown in FIG. 1 an electrical connector 8 comprising an insulative housing 10 which holds a plurality of signal contacts 12 in two longitudinal rows on opposite sides of a ground bus 14. The housing has a terminating face 16 and an opposite mating face 18. The connector 8 is adapted for terminating a flat ribbon cable 30 of the type having a plurality of signal conductors 32 and ground conductors 34 arranged in an alternating sequence in side-by-side parallel alignment within an insulative jacket 36. The cable 30 typically has a sufficient number of signal and ground conductors 32, 34 to extend across the length of the connector 8, although only a portion of the signal and ground conductors of the cable 30 are shown in FIG. 1. The cable 30 is applied to the connector so that the cable extends laterally across the terminating face 16 of the housing 10.

With further reference to FIGS. 2–5, the signal contacts 12 are installed in respective cavities 20 which are open to the terminating face 16 of the housing 10, and the ground bus 14 is installed in a ground bus slot 22 which is also open to the terminating face 16. The cavities 20 for the signal contacts typically extend through the housing so that they are also open to the mating face 18 of the housing. Each of the signal contacts 12 has a retention-section 62 that is interference fitted in one of the cavities 20 to retain the signal contact in the cavity. Each of the signal contacts 12 has a termination section 60 which extends above the terminating face 16 of the housing and includes a signal conductor termination slot 66. The slot 66 is bounded by opposed edges which are configured for insulation displacement termination of a respective signal conductor 32 that is inserted into the slot. Each of the signal contacts has a mating section which includes opposed beams 68 that mate with a pin of a mating connector (not shown) when the pin is inserted into the cavity 20 through the mating face 18.

Figure 6:
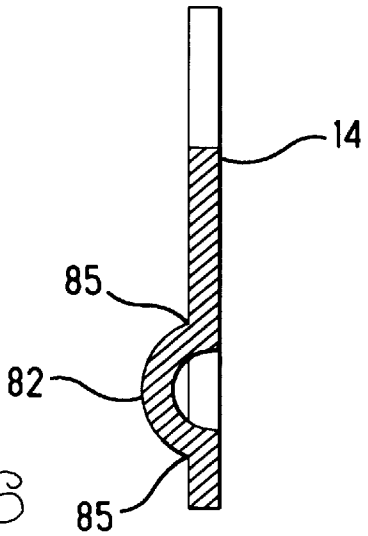
FIG. 6 is a cross-sectional view through a ground bus for the connector taken along line 6—6 of FIG. 3.
Figure 4:
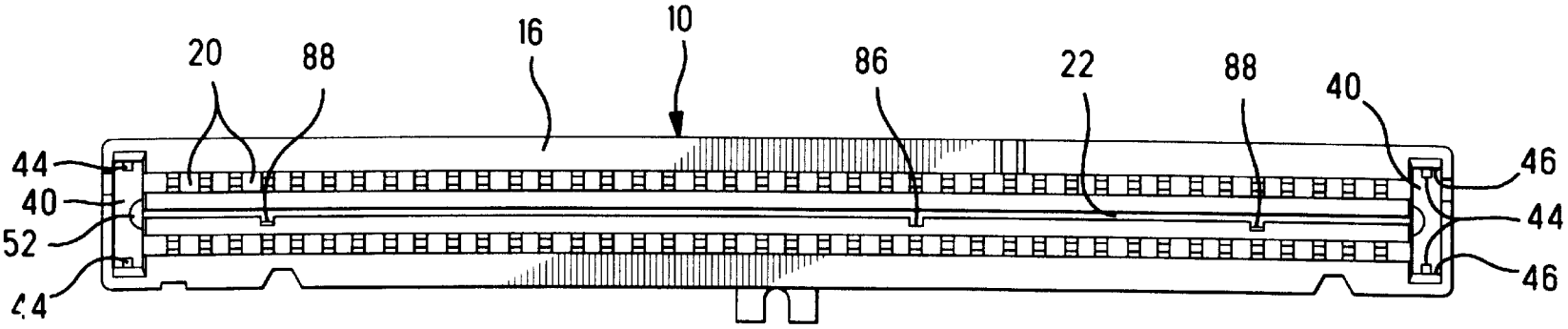
FIG. 4 is a top view of a housing for the connector.
Figure 5:
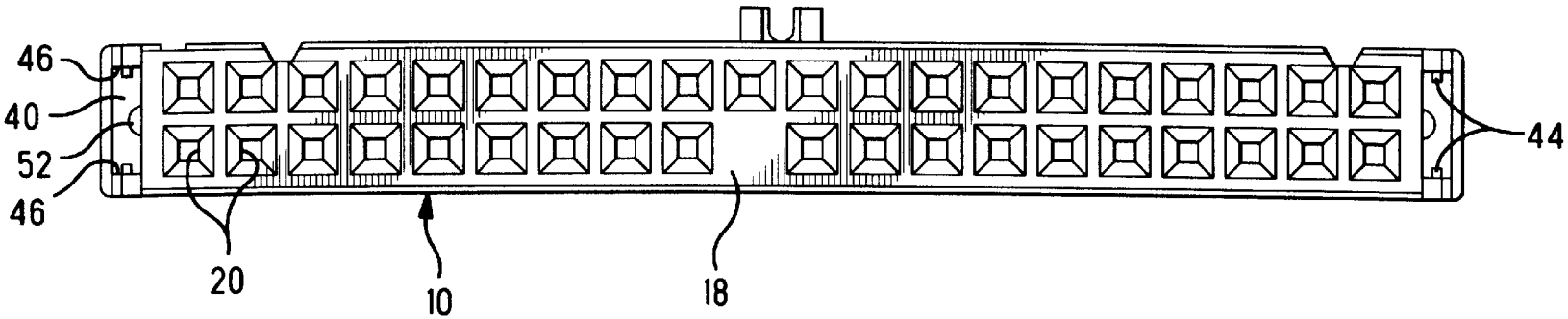
FIG. 5 is a bottom view of the connector housing.
Figure 7:
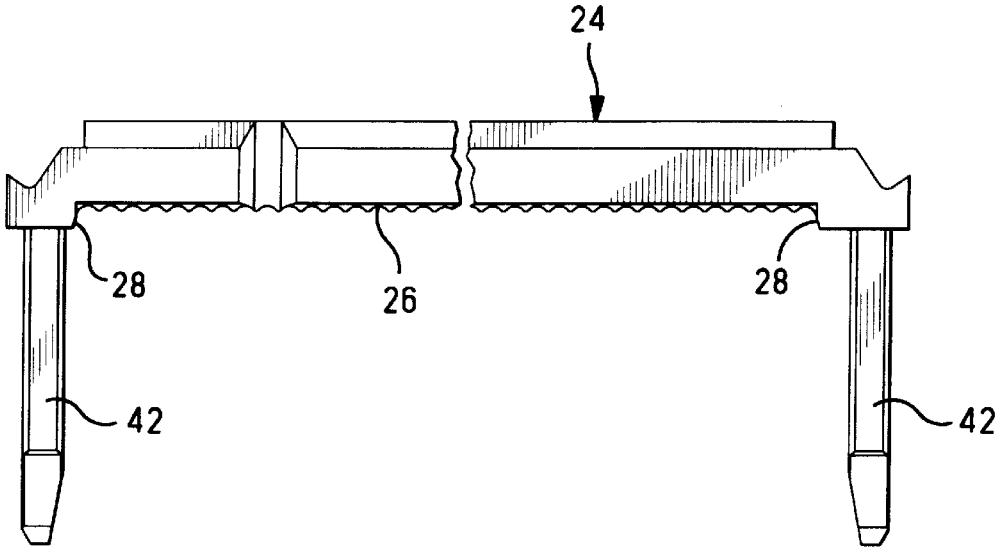
FIG. 7 is a front view of the connector cover.
Figure 8:
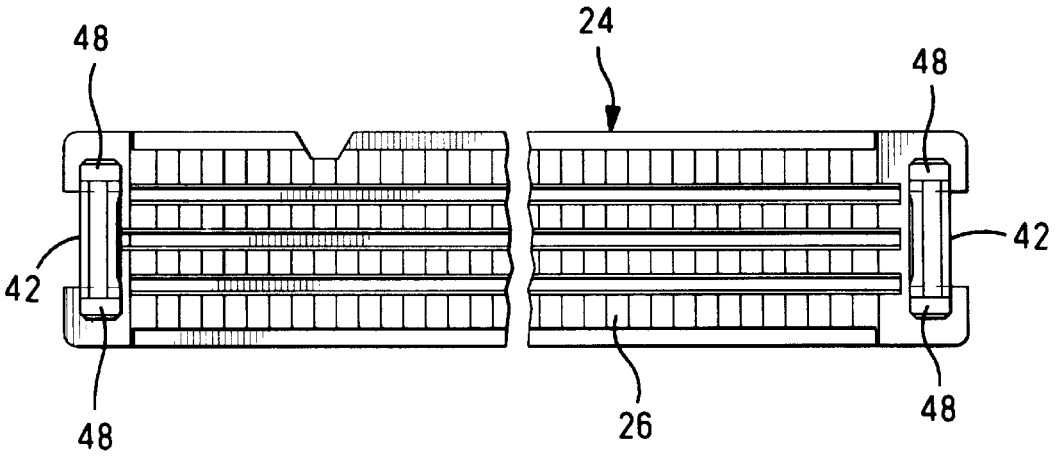
FIG. 8 is a bottom view of the connector cover.
Figure 9:
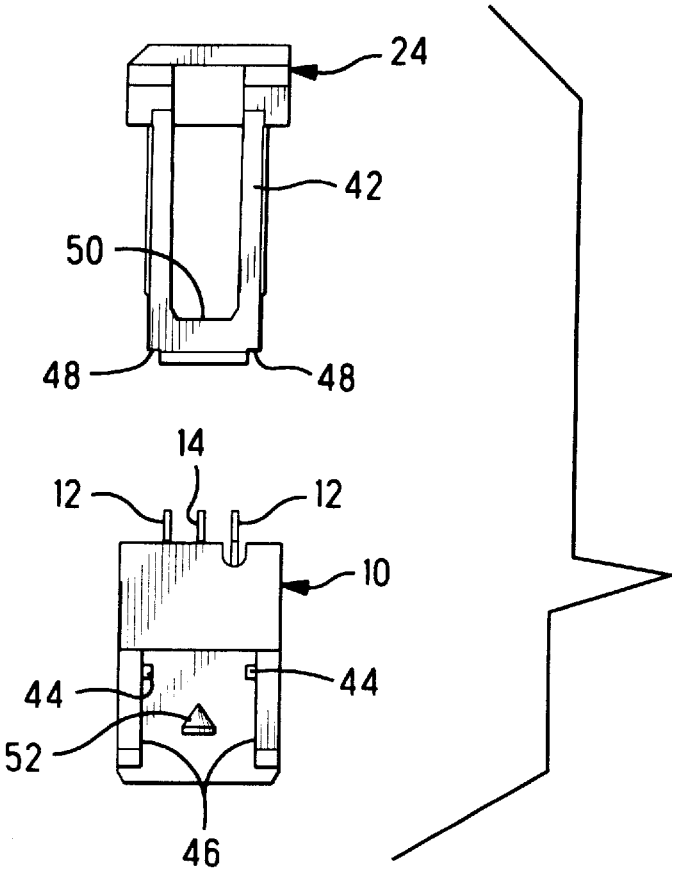
FIG. 9 is side view of the connector with the cover disposed for installation on the connector.

The ground bus 14 is stamped and formed from sheet material and is essentially planar except for three projections including a middle projection 82 and end projections 84 which are deformed out of a plane of the ground bus. As shown in FIG. 6, each of the projections 82, 84 is formed integrally in the ground bus into an arcuate-shaped strip having ends 85 that are attached to the ground bus. The projections 82, 84 are received in corresponding middle recess 86 and end recesses 88 in a side wall of the ground bus slot 22 as shown in FIG. 4. The projections 82, 84 cooperate with the recesses 86, 88 to retain the ground bus in the housing. Further, the middle projection 82 cooperates with the middle recess 86 to serve a keying function as will be explained hereinbelow.

Figure 2:
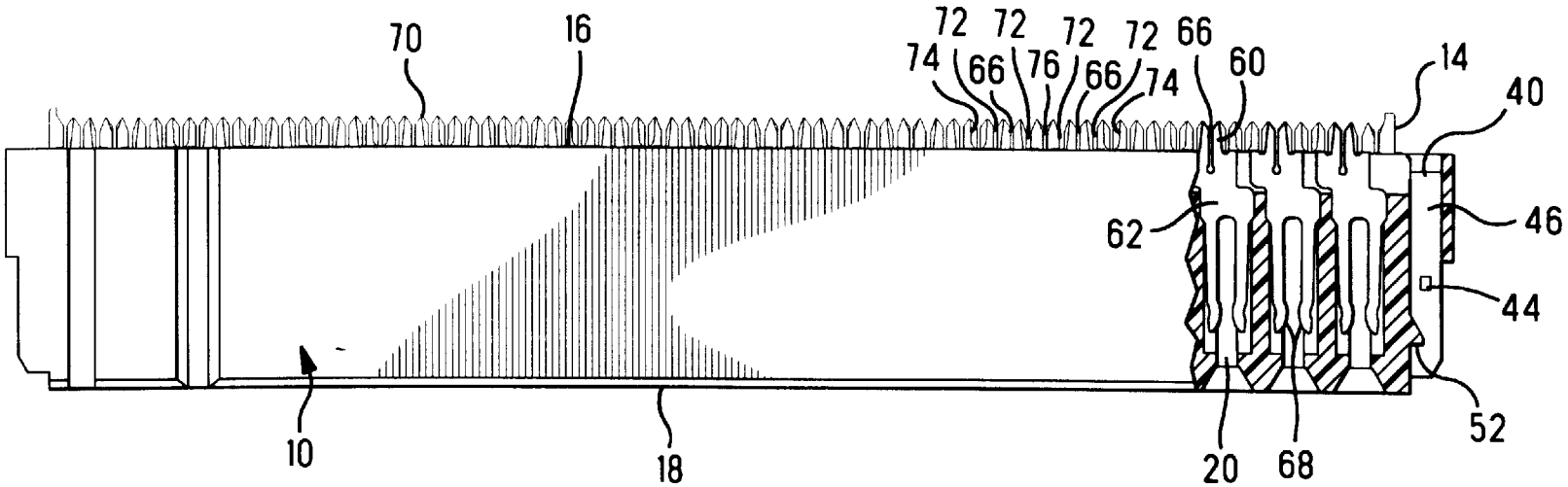
FIG. 2 is a front view of the connector with one end of the connector shown in cross-section.
Figure 3:
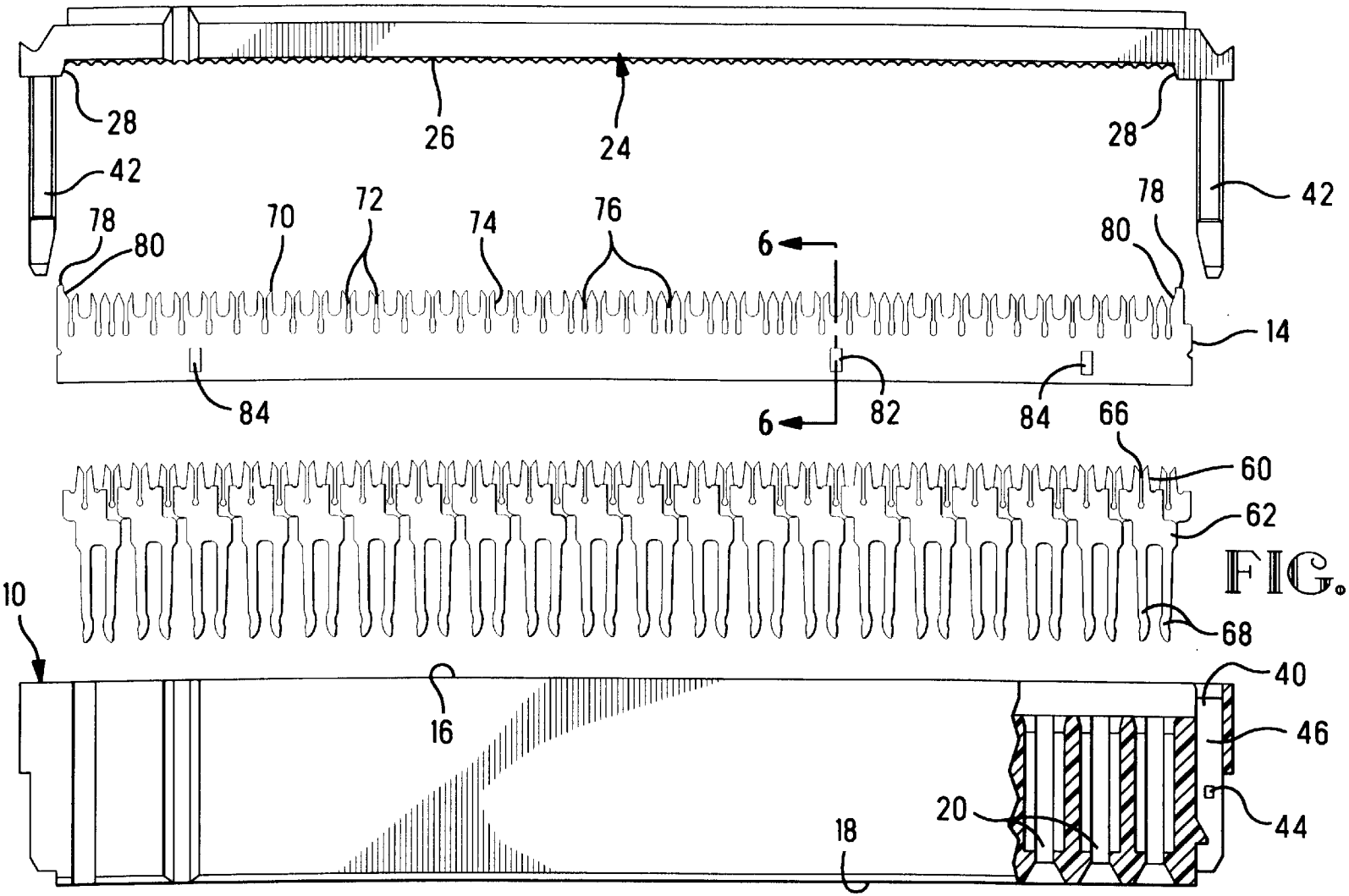
FIG. 3 is an exploded view of the connector shown in FIG. 2, and also showing a cover for the connector.

Referring to FIGS. 1–3, the ground bus 14 has an edge portion 70 which is formed as a termination section that extends above the terminating face 16 of the housing. The edge portion 70 is formed with a plurality of ground conductor termination slots 72 that are configured for insulation displacement termination of respective ones of the ground conductors 34. The edge portion 70 of the ground bus also has bypass slots 74 which are configured larger than the signal conductors 32. Each of the bypass slots 74 is laterally aligned with one of the signal conductor termination slots 66 of an associated signal contact 12. When the cable 30 is terminated to the connector 8 as shown in FIG. 1, the bypass slots 74 receive and accommodate the signal conductors 32 that are terminated in the associated signal contacts 12, thereby allowing the signal conductors to enter the edge portion 70 of the ground bus so as to extend through the ground bus without being terminated to the ground bus. Provision of the bypass slots 74 permits the signal conductor termination slots 66 in the signal contacts and the ground conductor termination slots 72 in the ground bus to be arranged such that the signal and ground conductors 32, 34 of the ribbon cable will all reside in a common plane adjacent to the terminating face 16 of the connector after termination thereto.

The edge portion 70 of the ground bus may also have signal conductor termination slots 76 which are configured for insulation displacement termination of selected ones of the signal conductors 32. Each of the signal conductor termination slots 76 may be provided in place of a corresponding bypass slot 74, thereby providing for selective termination of one of the signal conductors 32 to the ground bus 14. The signal conductor termination slots 76 may be selectively arranged on the ground bus. That is, the ground bus may be produced in different configurations each programmed to common different selected ones of the signal conductors 32 to the ground bus.

The different configurations of the ground bus can be installed in connector housings to provide flat cable electrical connectors which differ only by the programmed selection of the signal conductors to be grounded. In order to differentiate between programmed electrical connectors, the connector housings are color coded. However, there is still a need to prevent inadvertent installation of a ground bus programmed with one configuration into a connector housing that is color-coded for a different configuration. Therefore, the ground bus and the housing have cooperative keying features for each configuration. In particular, the middle projection 82 of the ground bus is located at a different position along the ground bus for each different programmed configuration of the ground bus, and the corresponding color-coded housing has a middle recess 86 in alignment with the projection.

Towers 78 at both ends of the ground bus have surfaces 79 that serve to align the cable 30 in the connector during termination.

With reference to FIGS. 3, 4 and 7–11, the connector 8 receives a cover 24 that is driven toward the housing 10 with the cable 30 therebetween to terminate the cable to the connector 8. The cover 24 has a scalloped surface 26 which accommodates the individual signal and ground conductors 32, 34 of the ribbon cable, thereby providing a nest for the cable. Side surfaces 28 of the nest are contoured to flank the cable closely, thereby helping to align the cable in the nest and in the connector.

Figure 10:
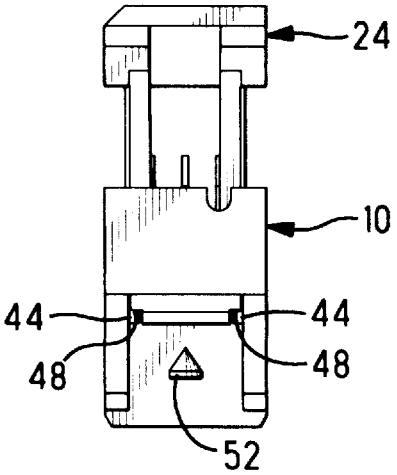
FIG. 10 is a side view of the connector with the cover installed in a pre-stage position.
Figure 11:
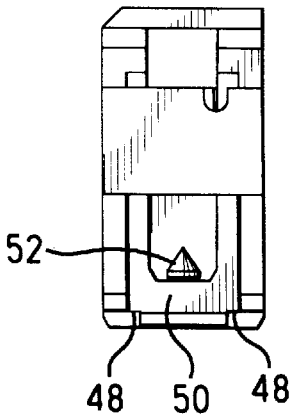
FIG. 11 is a side view of the connector with the cover installed in a fully assembled position.

Each longitudinal end of the housing 10 has a well 40 which receives a latch arm 42 of the cover 24. The housing has bumps or protuberances 44 which extend into each well 40 from side walls 46 thereof. A pair of the protuberances 44 are laterally opposed to each other within each well. The protuberances 44 act as stops which are abutted by shearing surfaces 48 of the latch arms 42 as the latch arms are inserted into the wells, thereby locating the cover at an initial, pre-stage position on the housing as shown in FIG. 10. The latch arms 42 have a slight interference fit between the side walls 46 of the wells, thereby providing a sufficient drag on the latch arms to keep the cover in the pre-stage position. In this position the cable 30 can be threaded between the cover 24 and the housing 10. Upon application of a force that drives the cover and the housing together, the protuberances 44 are sheared from the walls 46 of the well by the surfaces 48 on the latch arms 42. The cover is retained in a final, assembled position on the housing by latch bars 50 on the latch arms 42 which become locked beneath locking tabs 52 on the housing, as shown in FIG. 11.

The invention provides an electrical connector having signal contacts and a ground bus for terminating flat ribbon cable of the type having a plurality of signal and ground conductors arranged side-by-side within an insulative jacket. The invention has the advantages that the insulative jacket need not be stripped from the cable prior to termination, thereby avoiding a stripping operation, and the signal and ground conductors remain in a common plane after termination, thereby permitting the connector to have a small size.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector for terminating flat cable of the type having a plurality of signal conductors and ground conductors in parallel alignment, comprising:

a housing;

a plurality of signal contacts secured in the housing, each of the signal contacts having a signal conductor termination slot configured for insulation displacement termination of a respective one of said signal conductors; and a ground bus secured in the housing, the ground bus having a plurality of ground conductor termination slots each configured for insulation displacement termination of a respective one of said ground conductors, and at least one bypass slot configured to permit at least one of said signal conductors to pass through said ground bus without termination thereto;

the signal conductor termination slots, the ground conductor termination slots and the at least one bypass slot being arranged such that the plurality of signal conductors and ground conductors reside in a common plane in the connector after termination thereto.

2. The electrical connector according to claim 1, wherein the signal conductor termination slots, the ground conductor termination slots and the at least one bypass slot are open in a common direction.

3. The electrical connector according to claim 1, wherein the at least one bypass slot is aligned with one of said signal conductor termination slots.

4. The electrical connector according to claim 1, wherein the ground bus has towers for guiding the flat cable during termination to the connector.

5. The electrical connector according to claim 1, further comprising a cover which can be applied over the flat cable and moved to terminate the cable to the connector.

6. The electrical connector according to claim 1, wherein the ground bus has a signal conductor termination slot configured for insulation displacement termination of a respective said signal conductor.

7. The electrical connector according to claim 6, wherein the signal conductor termination slot in the ground bus is aligned with said signal conductor termination slot in one of said signal contacts.

8. The electrical connector according to claim 1, wherein the ground bus has projections which cooperate with recesses in the housing to secure the ground bus in the housing.

9. The electrical connector according to claim 8, wherein one of the projections and an associated one of the recesses are selectively positioned to key the ground bus to the connector housing.

10. An electrical connector for terminating flat cable of the type having a plurality of signal conductors and ground conductors in parallel alignment, comprising:

a housing;

a plurality of signal contacts secured in the housing, each of the signal contacts having a signal conductor termination slot configured for insulation displacement termination of a respective one of said signal conductors; and a ground bus secured in the housing, the ground bus having a plurality of ground conductor termination slots each configured for insulation displacement termination of a respective one of said ground conductors, and at least one bypass slot configured to permit at least one of said signal conductors to pass through said ground bus without termination thereto, said ground conductor termination slots and said bypass slot being aligned in a common plane.

11. The electrical connector of claim 10, wherein said ground conductor termination slots are in a common plane with said ground bus.

12. The electrical connector according to claim 10, wherein the at least one bypass slot is aligned with one of said signal conductor termination slots.

13. The electrical connector of claim 10, wherein at least three or more ground conductor termination slots are adjacent without a bypass slot therebetween.

14. The electrical connector of claim 13, wherein each ground conductor termination slot comprises piercing members, and wherein said adjacent ground conductor termination slots share piercing members.

15. The electrical connector according to claim 10, wherein the ground bus has a signal conductor termination slot configured for insulation displacement termination of a respective said signal conductor.

16. The electrical connector according to claim 15, wherein the signal conductor termination slot in the ground bus is aligned with said signal conductor termination slot in one of said signal contacts such that a single signal conductor is insertable in both slots.

17. The electrical connector according to claim 15, wherein the ground bus has a tower at each end thereof for guiding the flat cable during termination to the connector.

18. An electrical connector for terminating flat cable of the type having a plurality of signal conductors and ground conductors in parallel alignment, comprising:

a housing;

a plurality of signal contacts secured in the housing, each of the signal contacts having a signal conductor termination slot configured for insulation displacement termination of a respective one of said signal conductors; and a ground bus secured in the housing, the ground bus having a plurality of ground termination slots each configured for insulation displacement termination of a respective one of said ground conductors, and at least one bypass slot configured to permit at least one of said signal conductors to pass through said ground bus without termination thereto, said ground bus comprising a signal conductor termination slot configured for insulation displacement termination of a respective said signal conductor.

19. The electrical connector according to claim 18, wherein the at least one bypass slot is aligned with one of said signal conductor termination slots.

20. The electrical connector according to claim 19, wherein the signal conductor termination slot in the ground bus is aligned with said signal conductor termination slot in one of said signal contacts.

21. An electrical connector for terminating flat cable of the type having a plurality of signal conductors and ground conductors in parallel alignment, comprising:

a housing;

a plurality of signal contacts secured in the housing, each of the signal contacts having a signal conductor termination slot configured for insulation displacement termination of a respective one of said signal conductors; and a ground bus secured in the housing, the ground bus having a plurality of ground termination slots each configured for insulation displacement termination of a respective one of said ground conductors, said ground bus having towers at each end thereof for guiding the flat cable during termination to the connector.

22. The electrical connector according to claim 21, further comprising a cover which can be applied over the flat cable and moved to terminate the cable to the connector.

* * * * *